US006185242B1

(12) United States Patent
Arthur et al.

(10) Patent No.: US 6,185,242 B1
(45) Date of Patent: Feb. 6, 2001

(54) INTEGRAL SIDE WALL AND TAP HOLE COVER FOR AN ECCENTRIC BOTTOM TAP (EBT) ELECTRIC FURNACE

(75) Inventors: Mark Thomas Arthur, Franklin, TN (US); Frank Henry Miner, North Olmstead; Gordon Raymond Roberts, Strongsville, both of OH (US)

(73) Assignee: South Carolina Systems, Inc., El Dorado, AK (US)

( * ) Notice: Under 35 U.S.C. 154(b), the term of this patent shall be extended for 0 days.

(21) Appl. No.: 09/578,103

(22) Filed: May 24, 2000

(51) Int. Cl.[7] ..... F27D 1/12
(52) U.S. Cl. ..... 373/76; 373/72
(58) Field of Search ..... 373/2, 9, 71, 72, 373/73, 74, 75, 76, 77, 79, 84; 266/45, 46, 158, 193; 432/237

(56) References Cited

U.S. PATENT DOCUMENTS

| | | | | |
|---|---|---|---|---|
| 3,952,140 | * | 4/1976 | Wunsche | 373/72 |
| 4,715,042 | | 12/1987 | Heggert | 373/74 |
| 4,813,055 | | 3/1989 | Heggert | 373/74 |
| 4,815,096 | | 3/1989 | Burwell | 373/74 |
| 4,849,987 | | 7/1989 | Miner | 373/74 |
| 5,115,184 | | 5/1992 | Arthur et al. | 373/74 |
| 5,290,016 | * | 3/1994 | Elsner | 373/76 |
| 5,327,453 | | 7/1994 | Arthur | 373/74 |
| 5,330,161 | | 7/1994 | Lehr | 266/158 |
| 5,444,734 | | 8/1995 | Arthur | 373/74 |
| 5,561,685 | * | 10/1996 | Lehr et al. | 373/76 |
| 5,648,981 | | 7/1997 | Miner | 373/74 |
| 5,936,995 | * | 10/1999 | Sullivan et al. | 373/74 |

FOREIGN PATENT DOCUMENTS

| | | | |
|---|---|---|---|
| 1220503 | 4/1987 | (CA) | 307/18 |

* cited by examiner

*Primary Examiner*—Tu Ba Hoang
(74) *Attorney, Agent, or Firm*—Frederick J. McCarthy

(57) ABSTRACT

Spray cooled side wall and tap hole cover for an eccentric bottom tap (EBT) electric furnace which is unitary, i.e. one-piece, and has an inter-connected coolant supply and inter-connected spent coolant drain.

6 Claims, 7 Drawing Sheets

INTEGRAL SIDE WALL AND TAP HOLE COVER FOR AN ECCENTRIC BOTTOM TAP (EBT) ELECTRIC FURNACE

BACKGROUND OF THE INVENTION

This invention relates to a spray cooled system for the side wall and tap hole cover of an eccentric bottom tap (EBT) electric furnace, e.g. an electric arc furnace having a generally circular hearth portion, below one or more electrodes, in which steel scrap is melted, and an adjacent eccentrically configured relatively shallow portion which has a valved, bottom tap-hole through which molten steel can exit the furnace upon opening of the valve and tilting of the furnace.

The most common configuration of an EBT furnace comprises a main, "tall" section, which is spray or water-cooled, and positioned above the circular portion of the fiurnace and, an adjacent lower EBT (eccentric) extension that includes the "sand hole" through which sand is poured to cover and protect the tap hole valve of the fuxnace. The "tall" section is provided with a removable, circular water-cooled or spray cooled roof and scrap metal is charged to the furnace and melted beneath the roof. Upon completion of melting the entire furnace is tilted toward the eccentric (tap) portion with the tap valve is open to allow molten steel to be discharged from the furnace into a ladle positioned below the furnace. When tapping is completed, the taphole valve is closed and the furnace is leveled. Sand is then poured through the sand hole in the cover and into the tap-hole in the refractory hearth below to protect the underlying tap-hole valve. The furnace is then ready for melting and tapping the next charge.

The cover for the EBT (eccentric) portion is customarily a pressurized water-cooled panel or a separate spray cooled panel. The water-cooled panel is usually flat and horizontal and includes a sand hole. The separate spray cooled panel is a combination of a sloping plate and a conical portion which allows effective flow of water onto and off the plate. The spray-cooled panel also contains a sand hole and has a spray cooled chamber. In use, the separate spray cooled panel is bolted to the "tall" spray cooled section with each section having it's own coolant supply and independent drains for spent coolant. This type of spray cooled configuration is subject to fume and flame discharge at the joint between the main "tall" section and the EBT cover, and spent coolant can not equalize between the sections.

Another prior commercial arrangement included an egg-shaped roof which covered both the circular and EBT portions of the furnace which resulted in a single, very heavy "tall" section with the sand-hole located in the roof, high above the tap-hole which complicates filling of the tap-hole.

SUMMARY OF THE INVENTION

In accordance with the present invention, a spray cooled, hollow side wall is provided for the circular portion of an EBT furnace and a hollow EBT cover portion is integrally attached to the side wall, e.g. by welding to provide a unitary, i.e. one piece side-wall and tap-hole cover. The EBT cover portion is attached at a lateral mid-section of the side-wall and is vertically extending but to a much lesser extent than the side-wall, e.g. about ¼ to ⅓ the height of the side wall. The EBT cover portion is hollow and has an upper cover and a lower arched plate; the lower arched plate is spray cooled by nozzles within the EBT cover. The nozzles receive coolant, e.g. water, from a conduit which is connected to the water conduit in the spray cooled side-wall, and spent coolant can drain from the EBT cover to the side-wall, and, when the furnace is tilted, from the side-wall to the EBT cover. The lower plate of the EBT cover is shaped to conformally contact the inner spray cooled wall of the side-wall and this conformal contact is shielded by a metal strip which is welded to the inner wall of the side-wall and the lower plate and the weld area and metal strip are easily cooled by coolant from nozzles in the EBT cover.

DETAILED DESCRIPTION OF THE INVENTION

Figure 1:
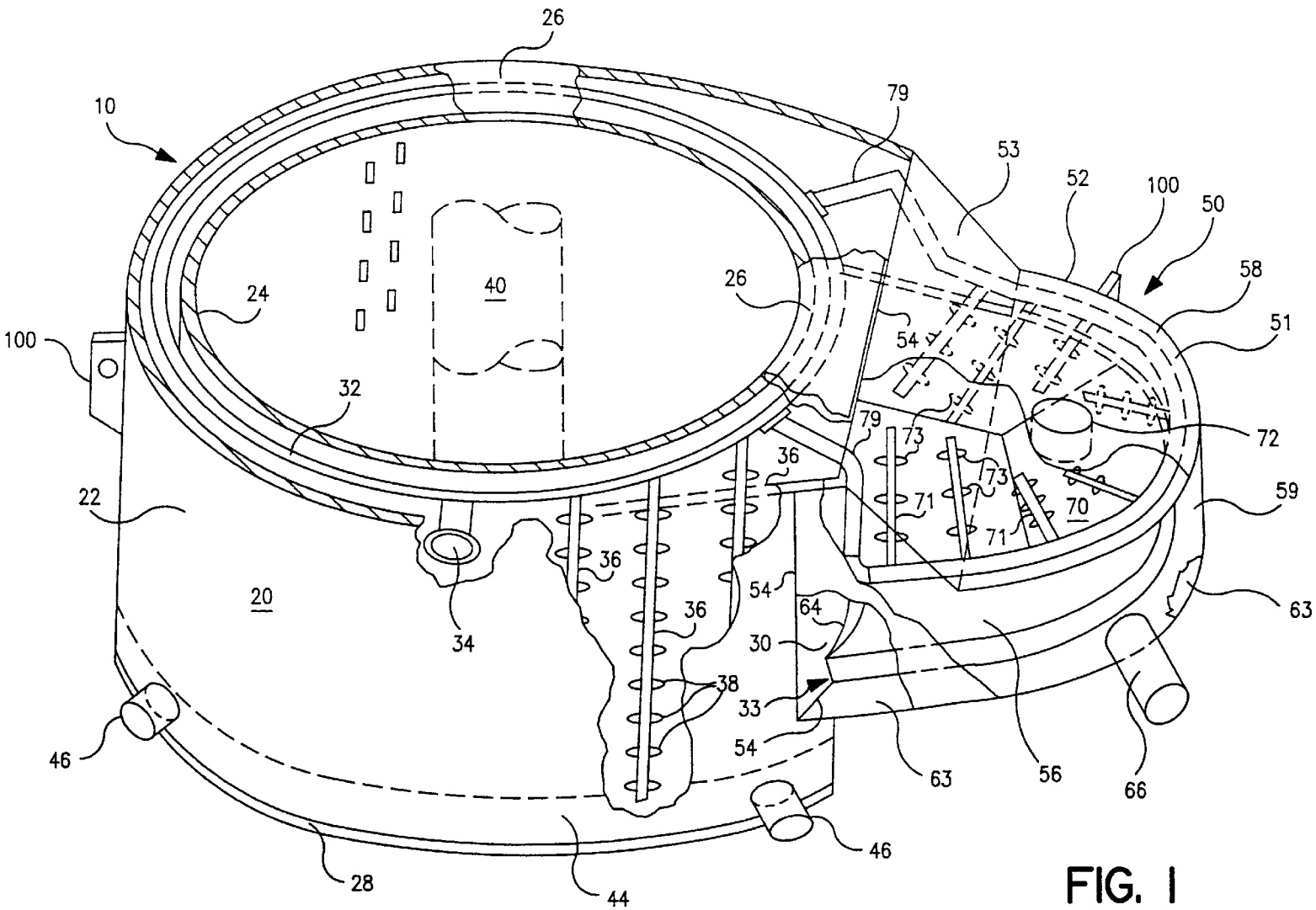
FIG. 1 is a perspective view of the integral unitary spray cooled side wall and tap hole cover for an EBT electric furnace.
Figure 2:
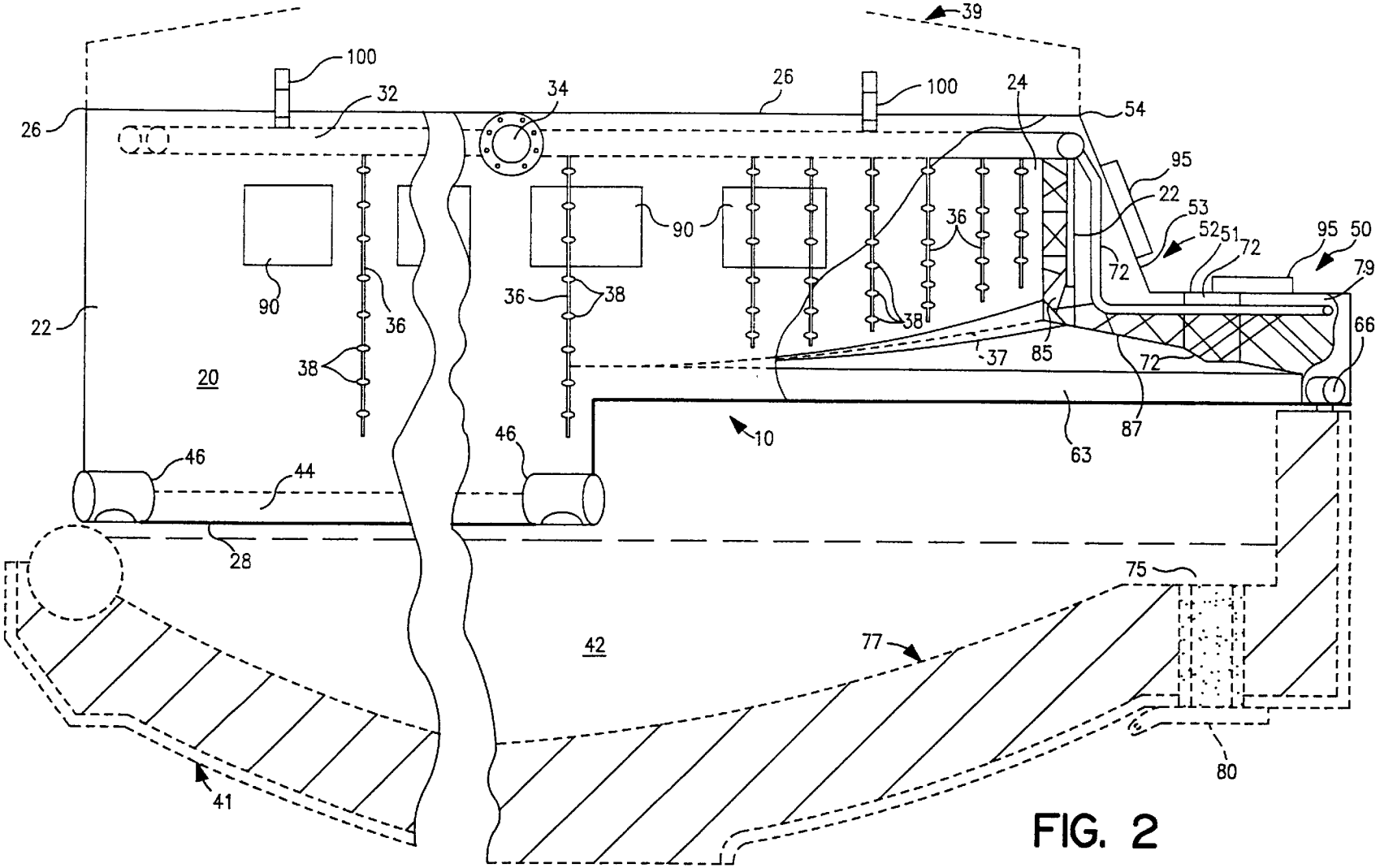
FIG. 2 is a fragmented, partially sectioned side elevation view of the apparatus of FIG. 1.
Figure 3A:
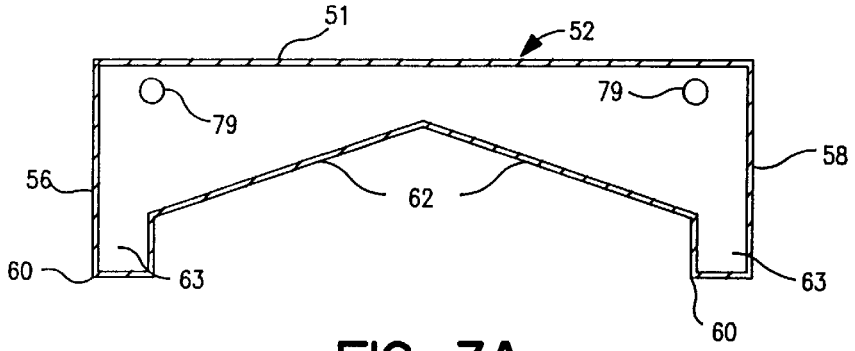
FIG. 3(A) is cross-section taken at A—A of FIG. 3.
Figure 3:
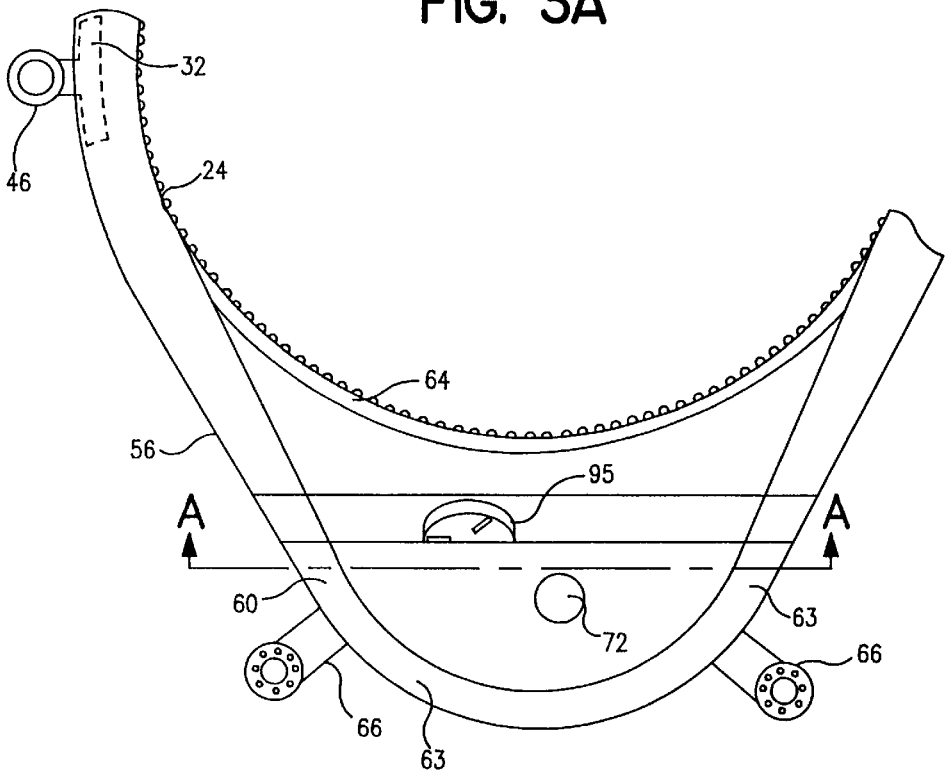
FIG. 3 is a partial top plan view of the EBT cover portion of the apparatus of FIG. 1.
Figure 7:
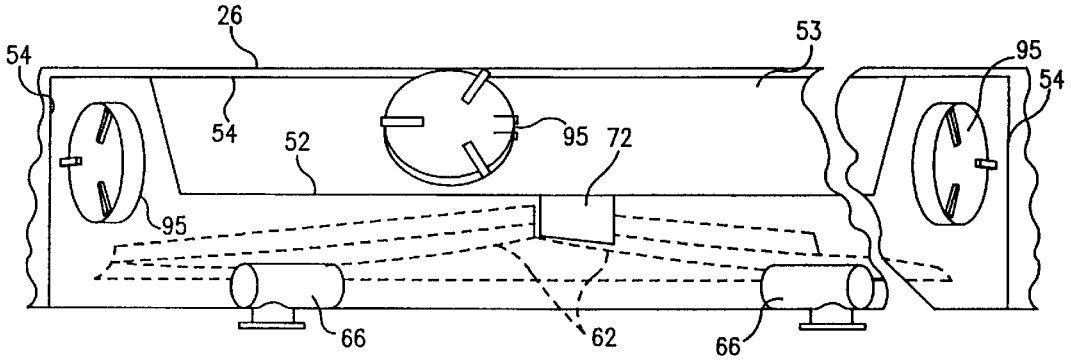
FIG. 7 is a partial front elevation view of the tap hole cover portion of the apparatus of FIG. 1.
Figures 4, 4A, 4B:
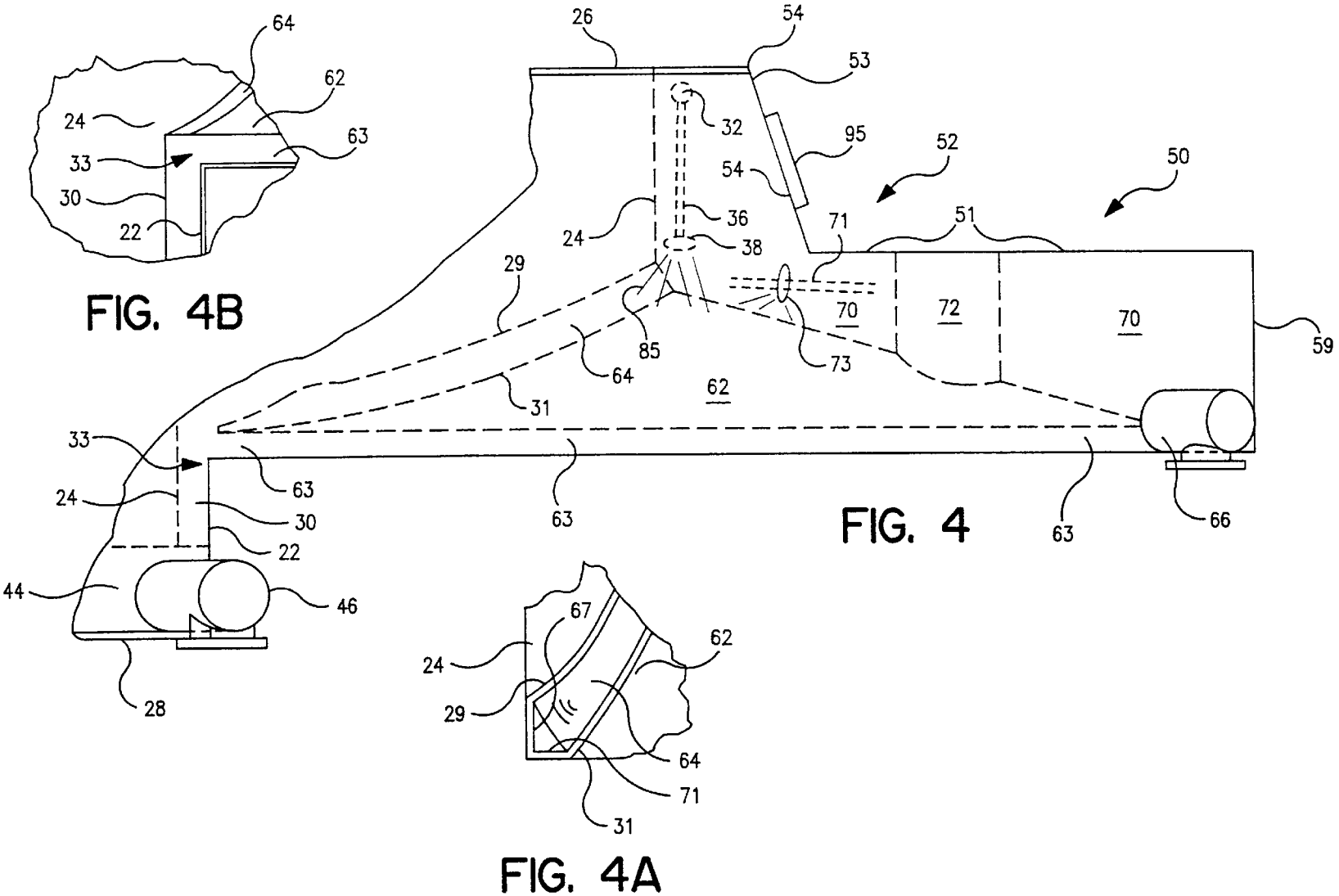
FIG. 4 is a partial plan view in section of the top hole portion of the apparatus of FIG. 1.
FIGS. 4(A), 4(B) are perspective views of portions of the apparatus of FIG. 4.
Figure 5:
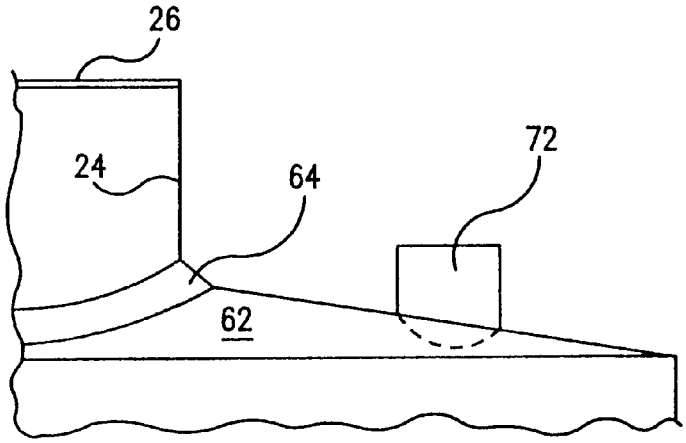
FIGS. 5 and 6 are partial sectional elevation views of the apparatus of FIG. 2.
Figure 6:
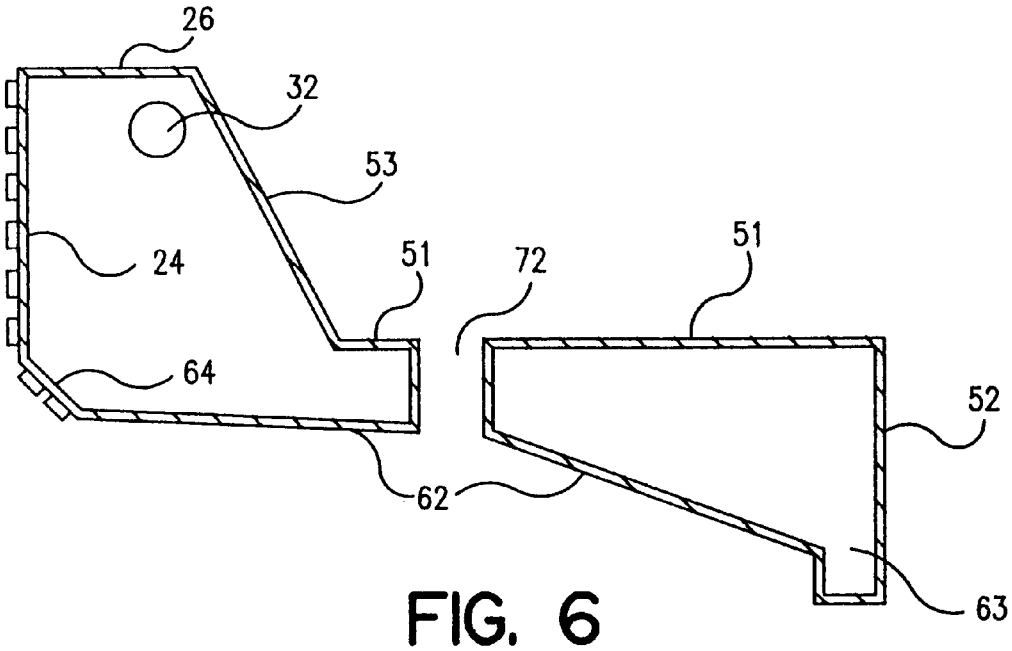
Figure 8:
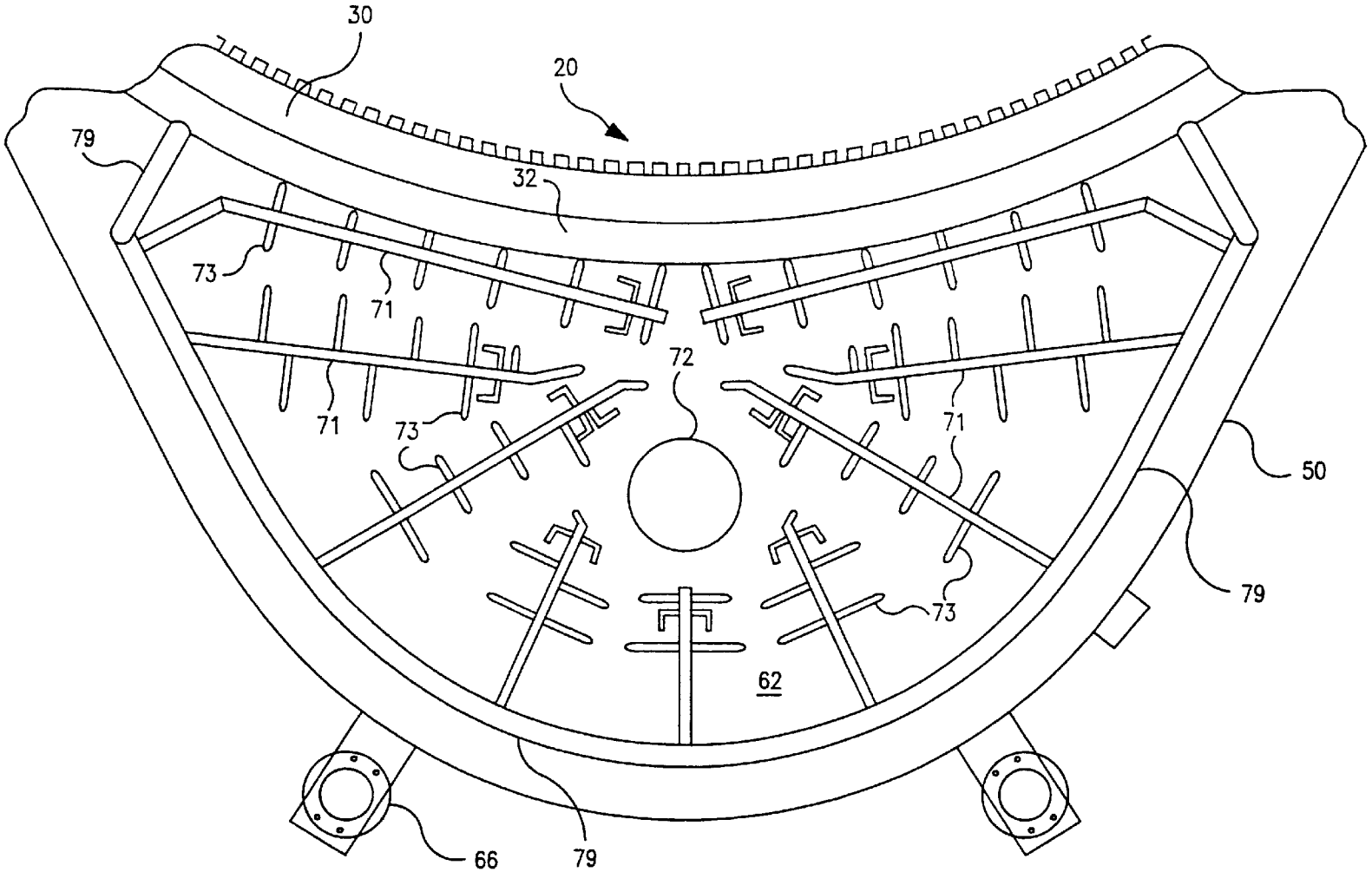
FIG. 8 is a partial plan view in section of the tap hole cover portion of the apparatus of FIG. 1.
Figure 9:
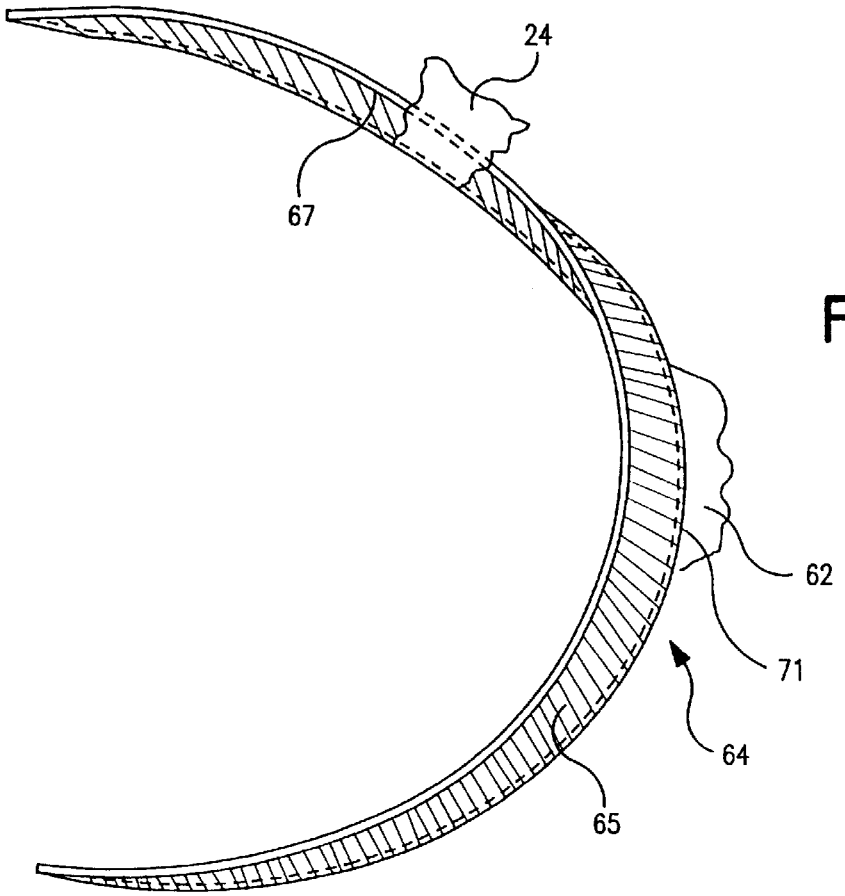
FIGS. 9 and 10 are perspective and plan views of a protective metal strip component of the present invention.
Figure 10:
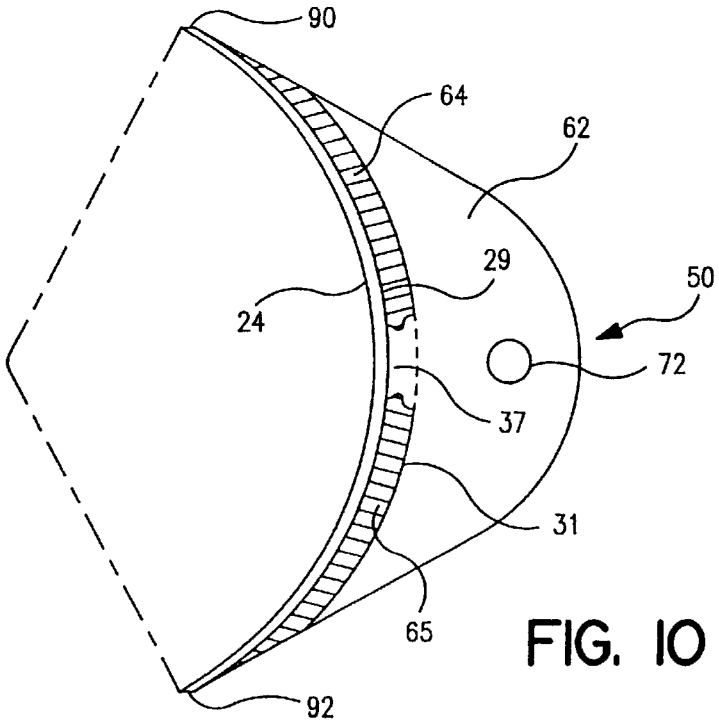

With reference to FIG. 1 and FIG. 2, the integral side wall and tap-hole cover of the present invention is indicated at 10 having a vertical circular hollow side wall 20 overlying the circular hearth 42 of furnace 41 Hollow side wall 20 comprises outer metal covering member 22, inner metal base member 24 and upper and lower metal flanges 26, 28, which join the metal covering member 22 and inner metal base member 24 and close the enclosed space 30 within side wall 20. Coolant header 32 is positioned in the uppermost portion of chamber 30 and extends peripherally along outer metal covering member 22. Coolant, e.g. water, is provided to coolant supply header 32 at coolant supply inlet 34 and coolant flows downwardly to vertical spray bars 36 which are located peripherally in enclosed space 30. Nozzles 38 spray droplets of water onto the surface of inner metal base member 24 in an amount sufficient to maintain an acceptable temperature in the inner metal base member 24 which is exposed to heat generated by electrode 40 in the course of arc melting scrap (not shown) in the hearth 42 shown FIG. 2. A spray cooled furnace roof 39, of the type described in U.S. Pat. No. 4,715,042-Heggart et al, can be provided as indicated schematically in FIG. 2. Spent coolant from nozzles 38 descends to channel 44 at the lowermost portion of chamber 30 and exits at openings 46 in outer metal covering member 22. The integral tap-hole cover 50 of the present invention, with further reference to FIGS. 4, 5, 6 and 7, comprises an upper metal cover member 52, having a horizontal portion 51, an upwardly slanting portion 53, vertical sides 56, 58, and vertical front portion 59. The tap hole cover 50 is welded to upper cover flange 26 side wall 20 at locations indicated at 54. With additional reference to FIGS. 3, 3(A) and FIGS. 5 and 6, the vertical sides 56, 58 and front portion 59 of upper metal cover member, 52 are welded at 60 to arched lower metal panel 62 to form EBT cover member drain 63 which communicates with enclosed space 30 of side wall 20 as indicated at 33 in FIG. 1 and FIGS. 4, 4(A) and 4(B). As shown in FIGS. 4, 4(A), lower metal plate 62 is affixed to the inner metal base member 24 by means of weld 29 and weld 31 at metal strip 64. As shown in FIGS. 9 and 10, metal strip 64, suitably steel; is shaped to cover the conformal contact 37 between cover plate 62 of tap hole cover 50 and inner metal base member 24 of side wall 20 which extends tangentially and convergingly from tangent points 90, 92 on metal base member 24. Metal strip 64 is suitably chamferred or beveled at its outer surface 65 and has sufficient mass to act as a heat-sink and protect the contacting edges of lower plate 62 and metal base member 24 at 37 from excessive heating due to the arc melting of scrap in hearth 42 of furnace 41 (FIG. 2). Metal strip 64 is welded at its back surface 67 to metal base member 64 and at its lower surface 71 to lower metal plate 62. In addition to acting as a heat sink, metal strip 64 acts as a seal to prevent the escape of furnace fumes and flame at conformal contact region 37. Metal strip 64 provides a dust and flame preventing peripheral seal at metal base member 24 and lower metal plate 62. With referance to FIGS. 1, 2 and 8, the joining of lower metal plate 62 to cover member 52 provides a hollow chamber 70 within tap-hole cover 50 which contains coolant conduit means 74 connected to coolant supply header 32 of side wall 20. Horizontally disposed spray bars 71 receive coolant from coolant conduit means 72 which is sprayed in droplets from nozzles 73 onto lower metal plate 62 and metal strip 64 as shown in FIG. 4 and FIG. 8 and also from nozzles 36 at 85 and 87. Spent coolant descends to drain 63 of tap-hole cover 50 and can exit drain openings 66 and also drain openings 46 of side-wall 20. A sand hole, i.e 72 is provided between the horizontal portion 51 of upper cover member 52 and lower metal plate 62 and is located generally over and relatively close to tap-hole 75 in hearth 77. The sand 99 in tap-hole 75 protects tap-hole valve 80. Inspection covers 90 and hatches 95 can be readily provided for ease of inspection and relocation. Lifting lugs 100, shown in FIGS. 1 and 2 are provided and the unitary side wall and cover can be lifted in one piece.

What is claimed is:

1. Integral unitary side wall and tap hole cover for an eccentric bottom tap electric furnace comprising:

(i) a substantially vertical hollow side wall of generally circular cross-section supported by the generally circular portion of an eccentric bottom tap electric furnace for surrounding at least one graphite electrode extending downwardly into the eccentric bottom tap electric furnace, said side wall having (a) an inner base metal member forming the inner portion of the hollow side wall;

(b) an outer metal covering member spaced from said inner metal base member (c) means for joining the outer metal covering member to the inner metal base member and for defining a substantially enclosed space between said inner metal base member and said metal covering member, said substantially enclosed space having a lowermost portion with at least one outer liquid drain opening being located at the lowermost portion of the enclosed space;

(d) a plurality of spray means located within said enclosed space at predetermined peripheral locations adjacent to and spaced from said inner metal base member for directing a spray of liquid coolant in the form of liquid droplets against the inner metal base member in an amount sufficient to maintain an acceptable temperature in said inner metal base member.

(e) a liquid coolant supply header within said enclosed space of said side wall extending peripherally along the inner metal base member for supplying liquid coolant to said plurality of spray means;

(f) at least one liquid coolant drain outlet means in communication with said at least one drain opening for receiving a flow of liquid coolant from inside of said enclosed space;

(ii) a liquid coolant supply conduit for supplying liquid to said liquid coolant supply header;

(iii) a hollow tap hole cover fixedly attached to said hollow side wall and extending away from said hollow side wall to overlie a tap hole portion of the eccentric bottom tap electric furnace, said hollow tap bole cover having an enclosed space and a lower plate affixed to the inner base metal member of said side wall and being directly over the tap-hole portion of the electric furnace and defining an opening for introducing sand into the tap-hole of the electric furnace, said enclosed space of the tap hole cover having a lowermost portion with at least one liquid coolant drain opening located at the lower most portion of the enclosed space of the tap hole cover, the lowermost portion of the tap hole cover being in communication with the substantially enclosed space between the inner metal base member and metal covering member of said side wall;

(a) a plurality of spray means located within the enclosed space of the tap-hole cover for directing a spray of liquid coolant in the form of liquid droplets against its lower plate in an amount sufficient to maintain an acceptable temperature in said lower plate;

(b) at least one liquid coolant drain outlet means for receiving flow of liquid coolant from inside said enclosed space of said hollow tap hole cover; and (c) conduit means within the enclosed space of the tap hole cover for supplying liquid coolant to the plurality of spray means within the enclosed space of the tap-hole cover, said conduit means being connected to the liquid coolant supply header within the enclosed space of the side wall.

2. Integral unitary side wall and tap hole cover for an eccentric bottom tap electric furnace in accordance with claim 1 wherein said hollow tap hole cover has vertical side portions which extend tangentially and convergingly away from the hollow side wall.

3. Integral unitary side wall and tap hole cover for an eccentric bottom tap electric furnace in accordance with claim 1 wherein the lowermost portion of the tap hole cover is in the form of a trough from which liquid coolant can flow by gravity from the tap hole cover into the enclosed space between the inner metal base member and metal covering member of said side wall.

4. Integral unitary side wall and tap hole cover for an eccentric bottom tap electric furnace in accordance with claim 1 wherein the lower plate of the tap hole cover has an arched crossed-section and conformally contacts the inner metal base member of the side wall and a metal strip is provided which is welded to said lower plate and inner metal base member to cover the conformal contact between said lower plate and said inner metal base member.

5. Integral unitary side wall and tap hole cover for an eccentric bottom tap electric furnace in accordance with claim 1 wherein the tap hole cover is provided with an upper covering element which affixed by welding to the outer metal covering member of the side wall.

6. Integral unitary side wall and tap hole cover for an eccentric bottom tap electric furnace comprising:

(i) a substantially vertical hollow side wall of generally circular cross-section supported by the generally circular portion of an eccentric bottom tap electric furnace for surrounding at least one graphite electrode extending downwardly into the eccentric bottom tap electric furnace, said side wall having (a) an inner base metal member forming the inner portion of the hollow side wall;

(b) an outer metal covering member spaced from said inner metal base member (c) means for joining the outer metal covering member to the inner metal base member and for defining a substantially enclosed space between said inner metal base member and said metal covering member, said substantially enclosed space having a lowermost portion with at least one outer liquid drain opening being located at the lowermost portion of the enclosed space;

(d) a plurality of spray means located within said enclosed space at predetermined peripheral locations adjacent to and spaced from said inner metal base member for directing a spray of liquid coolant in the form of liquid droplets against the inner metal base member in an amount sufficient to maintain an acceptable temperature in said inner metal base member;

(e) a liquid coolant supply header within said enclosed space of said side wall extending peripherally along the inner metal base member for supplying liquid coolant to said plurality of spray means;

(f) at least one liquid coolant drain outlet means in communication with said at least one drain opening for receiving a flow of liquid coolant from inside of said enclosed space;

(ii) a liquid coolant supply conduit for supplying liquid to said liquid coolant supply header;

(iii) a hollow tap bole cover fixedly attached to said hollow side wall and extending tangentially and convergingly away from said hollow side wall to overlie a tap hole portion of the eccentric bottom tap electric furnace, said hollow tap hole cover having an enclosed space and an arch shaped lower plate affixed at a conformal contact to the inner base metal member of said side wall by welding and being directly over the tap-hole portion of the electric furnace and defining an opening for introducing sand into the tap-hole of the electric furnace, said enclosed space of the tap hole cover having a lowermost portion in the shape of a trough with at least one liquid coolant drain opening located at said trough, said trough being in communication with the substantially enclosed space between the inner metal base member and metal covering member of said side wall to permit the flow by gravity of coolant from the tap hole cover to the enclosed space of the side wall;

(a) a plurality of spray means located within the enclosed space of the tap-hole cover for directing a spray of liquid coolant in the form of liquid droplets against its lower panel in an amount sufficient to maintain an acceptable temperature in said lower panel;

(b) at least one liquid coolant drain outlet means for receiving a flow of liquid coolant from inside said enclosed space of said hollow tap hole cover; and (c) conduit means within the enclosed space of the tap hole cover for supplying liquid coolant to the plurality of spray means within the enclosed space of the tap-hole cover, said conduit means being connected to the liquid coolant supply header within the enclosed space of the side wall;

(iv) a metal strip welded to said lower panel and said inner metal base member to cover the conformal contact there between; and (v) lifting lugs attached to said hollow side wall and said hollow tap hole cover for lifting as one piece.

* * * * *